US007973655B2

(12) United States Patent
Blinnikka et al.

(10) Patent No.: US 7,973,655 B2
(45) Date of Patent: Jul. 5, 2011

(54) MOBILE DEVICE TRACKING AND LOCATION AWARENESS

(75) Inventors: Tomi Blinnikka, San Pablo, CA (US); Jeffery Bennett, San Francisco, CA (US); Marc E. Davis, San Francisco, CA (US)

(73) Assignee: Yahoo! Inc., Sunnyvale, CA (US)

( * ) Notice: Subject to any disclaimer, the term of this patent is extended or adjusted under 35 U.S.C. 154(b) by 275 days.

(21) Appl. No.: 11/945,913

(22) Filed: Nov. 27, 2007

(65) Prior Publication Data

US 2009/0135002 A1 May 28, 2009

(51) Int. Cl.
*G08B 1/08* (2006.01)

(52) U.S. Cl. ..... 340/539.13; 340/539.32; 455/456.1

(58) Field of Classification Search ..... 340/539.11, 340/539.13, 539.22; 455/456.1
See application file for complete search history.

(56) References Cited

U.S. PATENT DOCUMENTS

| | | | | |
|---|---|---|---|---|
| 5,652,570 | A * | 7/1997 | Lepkofker | 340/573.4 |
| 5,796,338 | A * | 8/1998 | Mardirossian | 340/571 |
| 6,100,806 | A * | 8/2000 | Gaukel | 340/573.4 |
| 6,362,736 | B1 * | 3/2002 | Gehlot | 340/568.1 |
| 6,377,179 | B1 * | 4/2002 | Fulton | 340/573.1 |
| 6,556,819 | B2 * | 4/2003 | Irvin | 455/410 |
| 6,661,372 | B1 * | 12/2003 | Girerd et al. | 342/357.12 |
| 6,864,789 | B2 * | 3/2005 | Wolfe | 340/539.1 |
| 6,940,407 | B2 * | 9/2005 | Miranda-Knapp et al. | 340/572.1 |
| 7,218,226 | B2 * | 5/2007 | Wehrenberg | 340/571 |
| 7,518,500 | B2 * | 4/2009 | Aninye et al. | 340/506 |
| 7,548,161 | B2 * | 6/2009 | Wehrenberg | 340/568.1 |
| 7,558,587 | B2 * | 7/2009 | Albal et al. | 455/509 |
| 2005/0027844 | A1 * | 2/2005 | Hariprasad et al. | 709/223 |
| 2006/0111143 | A1 * | 5/2006 | Pande et al. | 455/556.1 |
| 2006/0161628 | A1 * | 7/2006 | Nagy et al. | 709/206 |
| 2008/0132245 | A1 * | 6/2008 | Snow et al. | 455/456.1 |
| 2008/0186162 | A1 * | 8/2008 | Rajan et al. | 340/539.13 |

OTHER PUBLICATIONS

Computrace LoJack for Laptops, Absolute Software Corp., 2007 <https://www.lojackforlaptops.com>.
LoJack, LoJack Corporation, 2007 <www.lojack.com>.

(Continued)

*Primary Examiner* — Eric M Blount
(74) *Attorney, Agent, or Firm* — Frommer Lawrence & Haug LLP; John W. Branch

(57) ABSTRACT

A system is provided for tracking a mobile device by enabling a user to remotely monitor the external surrounding environment of the mobile device. Initially, a mobile device is configured to selectively report on the device's surrounding environment based on one or more reporting events. Upon an occurrence of a reporting event, the mobile device generates a report by capturing at least one sensory datum related to its external surrounding environment. At least one locating datum is included in the report which can provide at least an approximate geographic location of the mobile device at the time the report is generated. Once the report is generated, the mobile device selectively sends the report to a tracking assist server, which makes the report remotely accessible to the user. Accordingly, when a mobile device is missing, a user can review one or more reports accessible on the server to determine whether the mobile device is stolen. Additionally, the at least one sensory datum provided in the one or more reports can be used to assist the user or others in identifying persons and/or objects in the surrounding environment of the mobile device, which may lead to the identification of the thief and/or recovery of the mobile device.

20 Claims, 6 Drawing Sheets

OTHER PUBLICATIONS

Brunato, M. et al., "PILGRAM: A Location Broker and Mobility-Aware Recommendation System" Technical Report DIT-02-0092, Universita di Trento, Oct. 2002, 8 pages.

Nedos, A. et al., "Proximity Based Group Communications for Mobile ad Hoc Networks," Global Smart Spaces, GLOSS, Version 0.2, Oct. 2003, 31 pages.

* cited by examiner

MOBILE DEVICE TRACKING AND LOCATION AWARENESS

FIELD OF THE INVENTION

The present invention relates generally to a system for tracking a mobile device and, in particular but not exclusively, to capturing information from the surrounding environment of the mobile device to assist a user in tracking the device.

BACKGROUND OF THE INVENTION

Mobile devices are prone to being mislaid or stolen. Retrieval of a lost device can be difficult due to its small size and/or portability, which make the device easy to hide and/or carry away. Even when a user has a notion of the approximate location of a mislaid mobile device, the user may not be able to easily locate the device because the device may have been moved by another, the area of the approximate location may be large, or other objects may obscure the device from plain view. Additionally, if the mobile device is stolen, the identity of the thief may be difficult or impossible to obtain once the device is removed from the user's presence or the thief abandons or passes to the device to another.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Embodiments, which is to be read in association with the accompanying drawings, wherein.

DETAILED DESCRIPTION OF THE EMBODIMENTS

Figure 1:
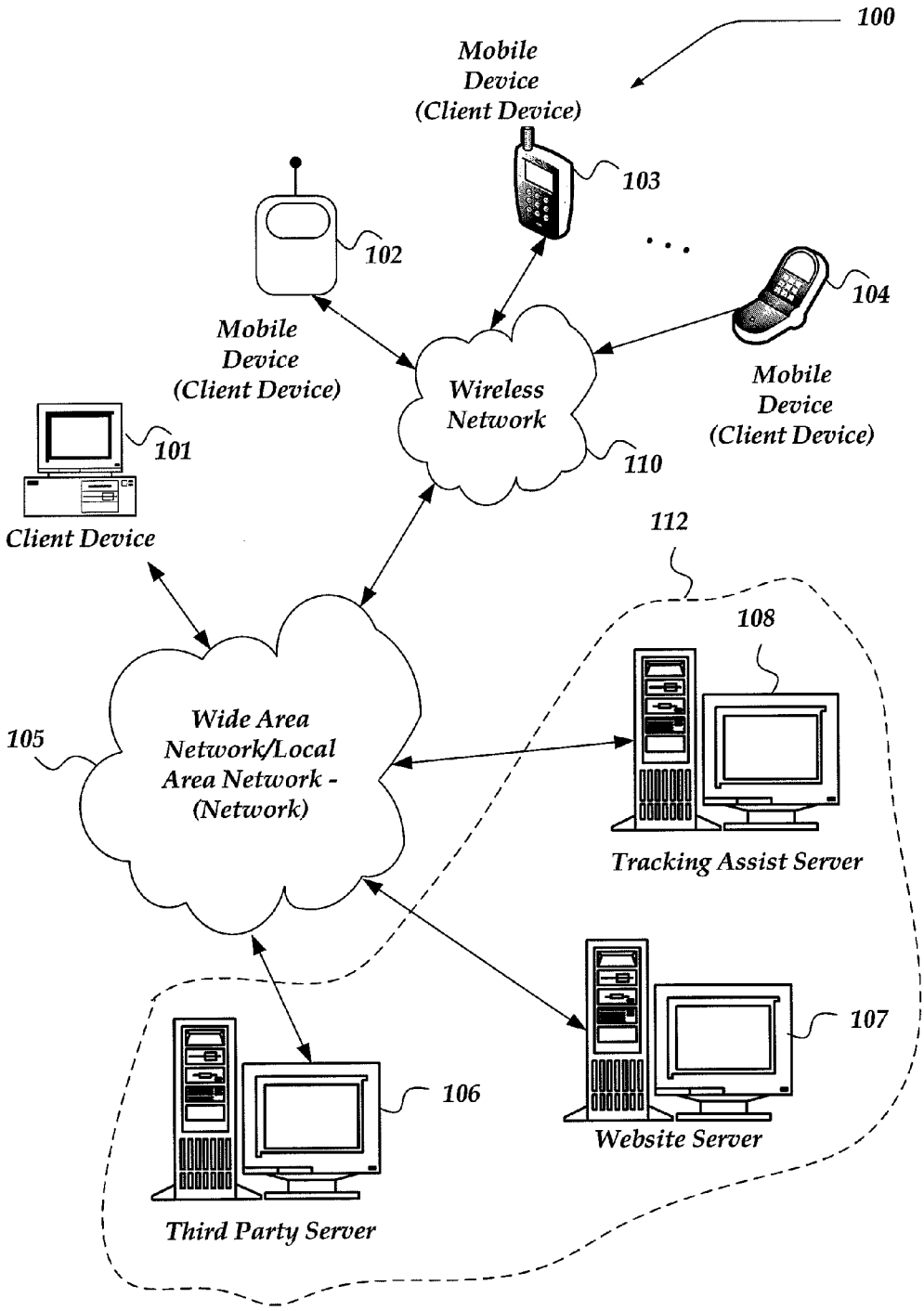
FIG. 1 illustrates a diagram of one embodiment of an exemplary system in which the invention may be practiced.

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, the term "receiving" an item, such as a request, response, or other message, from a device or component includes receiving the message indirectly, such as when forwarded by one or more other devices or components. Similarly, "sending" an item to a device or component includes sending the item indirectly, such as when forwarded by one or more other devices or components.

As used herein, the term "mobile client application" refers to an application that runs on a mobile device. A mobile client application may be written in one or more of a variety of languages, such as C, C++, J2ME, Brew, Java, and the like. Browsers, email clients, text messaging clients, calendars, and games are examples of mobile client applications.

Briefly stated, the present invention is directed toward a system for tracking a mobile device by enabling a user to remotely monitor the external surrounding environment of the mobile device. Initially, a mobile device is configured to selectively report on the device's surrounding environment based on one or more reporting events. Upon an occurrence of a reporting event, the mobile device generates a report by capturing at least one sensory datum related to its external surrounding environment. At least one locating datum is included in the report which can provide at least an approximate geographic location of the mobile device at the time the report is generated. Once the report is generated, the mobile device selectively sends the report to a tracking assist server, which makes the report remotely accessible to the user. Accordingly, when a mobile device is missing, a user can review one or more reports accessible on the server to determine whether the mobile device is stolen. Additionally, the at least one sensory datum provided in the one or more reports can be used to assist the user or others in identifying persons and/or objects in the surrounding environment of the mobile device, which may lead to the identification of the thief and/or recovery of the mobile device.

A reporting event specifies a circumstance in which a mobile device is configured to selectively report on its surrounding environment. A reporting event can be defined by any activity on the mobile device. In at least one or more embodiments, a reporting event is defined as a particular user interaction with the mobile device. For example, a mobile device can be configured to report on its surrounding environment when a user attempts to access or utilize one or more capabilities of the mobile device, when a user starts or shuts down the mobile device, or when a user starts an application on the mobile device. Also, in at least one or more embodiments, a reporting event can be defined as a change in a state of the mobile device, For example, a mobile device can be configured to report on its surrounding environment when the mobile device awakens from a sleep mode, gains or regains access to a network, a failed attempt to enter a password to enable operation of the mobile device, a failed attempt to unlock the mobile device, or a change in the amount of power the mobile device consumes. Further, in at least one or more embodiments, a reporting event can be based on a communication over a network. For example, a mobile device can be configured to report on its surrounding environment when it receives a message over the network requesting that the mobile device report on its surrounding environment.

In at least one or more embodiments, a mobile device is configured to selectively report on its surrounding environment when a browser on the mobile device is started. Also, in at least one or more embodiments, the browser is configured to open a home page which includes one or more of a script, a flash file, an applet, a java program, or other executable code for causing the mobile device to selectively report on its surrounding environment. Further, in at least one or more embodiments, the configured home page causes the browser to open another page once the mobile device selectively reports on its surrounding environment.

In at least one or more embodiments, an application is installed on a mobile device which detects reporting events and causes the mobile device to selectively report on its surrounding environment. Also, in at least one or more embodiments, an interface is provided to enable a user to specify one or more reporting events to the installed application. Further, in at least one or more embodiments, the installed application is downloaded onto the mobile device over a network.

In generating a report of the surrounding environment, a mobile device utilizes at least one sensor to capture at least one sensory datum of its external surrounding environment. A sensor can be any device capable of obtaining information about the external surrounding environment of the mobile device and includes such devices as, for example, a camera, a thermometer, a microphone, an accelerometer, a light meter, a global positioning system (GPS) receiver, a transceiver, and the like. A sensory datum obtained from a sensor can include, for example, an image of the surrounding environment, a temperature of the surrounding environment, an audio recording of the surrounding environment, an acceleration associated with the surrounding environment, a light level of the surrounding environment, a location of the surrounding environment, and the like. Additionally, sensory datum can include identifying information of a network device in the surrounding environment such as, for example, a wireless area network (WLAN) access point name, a Bluetooth device name, a network address, an internet protocol (IP) address, a router name, and the like.

A report of the surrounding environment of the mobile device includes at least one sensory datum and at least one locating datum. A locating datum provides a geographic location of the mobile device and/or can be utilized to ascertain a geographic location of the mobile device. For example, a locating datum can include a street address, latitude and/or longitude coordinates, and the like. Additionally, a locating datum can include, for example, a zip code, a network address, an IP address, a cell tower identification, an access point name, or the like which can be used to obtain an approximate geographic location of the mobile device by referring to a mapping table that maps such locating datum with geographic locations.

In at least one or more embodiments, at least one locating datum is obtained by utilizing at least one sensor on the mobile device. For example, a mobile device with a GPS receiver can be configured to capture the longitude and/or latitude coordinates of the mobile device for the at least one locating datum when generating a report. Also, in at least one or more embodiments, the at least one locating datum is obtained prior to a generation of a report or an occurrence of a reporting event. For example, a mobile device with a transceiver configured for the internet protocol may obtain a dynamic IP address when the mobile device gains access to an IP network. This dynamic IP address may later be used as a locating datum for a report if the IP address remains valid when the report is generated.

In at least one or more embodiments, a report can be in a form of one or more packets that can be sent over a network from the mobile device to the server. Also, in at least one or more embodiments, at least one locating datum can be included as a part of the header of a packet. Further, in at least one or more embodiments, at least one sensory datum and/or at least one locating datum can be included in the payload portion of a packet. Additionally, in at least one or more embodiments, a report can be in a form of an email.

In at least one or more embodiments, a report can include additional information such as a map which shows the geographical location of the mobile device based on the at least one locating datum.

In at least one or more embodiments, a report is saved on the mobile device if the mobile device cannot communicate with the server. Also, in at least one or more embodiments, the mobile device sends a saved report to the server once communication is established with the server. Further, in at least one or more embodiments, a report or a portion of a report is encrypted prior to being sent to the server.

A tracking assist server can be any server capable of receiving a report from a mobile device and making it accessible to the user. For example, a tracking assist server can be an email server, a web server that provides a web interface to enable users to accesses one or more reports, or the like.

In at least one or more embodiments, an interface is provided to enable a user to register the mobile device with the server. For example, a web interface associated with the server can be provided to enable the user to register the mobile device from a browser on the mobile device and/or from a browser on a separate device. In another example, the mobile device can be registered by speaking with a customer representative of an entity that is associated with the server. Also, in at least one or more embodiments, an application is made available for downloading onto the mobile device to enable the mobile device to communicate and/or register with the server.

In at least one or more embodiments, the server sends a confirmation request to the mobile device to confirm that the device is to be registered. Also, in at least one or more embodiments, an interface is provided on the mobile device to enable the user to confirm with the server that the mobile device is to be registered. For example, the server may send a Short Message Service (SMS) message to the mobile device to request confirmation that the device is to be registered. In another example, an interface on the mobile device is provided to enable the user to send a SMS message from the mobile device to the server to confirm and complete the registration.

In at least one or more embodiments, an interface is provided to enable the user to access one or more reports on the server. Also, in at least one or more embodiments, a user must login to access one or more reports on the server.

In at least one or more embodiments, an interface is provided to enable a user to specify one or more criteria to the server which when satisfied causes the server to alert the user of a received report. For example, an interface can be provided to enable a user to specify one or more known geographic locations to the server. Furthermore, the user can specify to the server that the user should be alerted if the server receives a report having at least one locating datum that indicates that the mobile device is located outside the at least one known geographic locations. Also, in at least one or more embodiments, an interface is provided to enable a user to specify how the user is to be alerted. For example, a user can be alerted by an email, a text message, a page, a telephone call, or the like.

In at least one or more embodiments, an interface is provided to enable a user to request a report from the mobile device by employing a separate device such as the server. Also, in at least one or more embodiments, the server communicates with the mobile device to obtain a report. Further, in at least one or more embodiments, the mobile device communicates with the server periodically or at configured times to determine whether a user is requesting a report. Additionally, if the mobile device determines that a report is requested, the mobile device generates a report and sends it to the server.

In at least one or more embodiments, a mobile device of the present invention can be integrated with a vehicle or another object to enable monitoring of the surrounding environment of the vehicle or the object. Also, in at least one or more embodiments, one or more sensors of the vehicle or the other object can be made accessible to the mobile device. For example, a mobile device of the present invention can be integrated with a car having a bumper camera. Additionally, the mobile device can be configured to have access to the bumper camera. Accordingly, the mobile device can be configured to report on the car's surrounding environment.

In at least one or more embodiments, an online platform for enabling the invention can be arranged to operate as a system in one or more local or remote environments, including peer to peer, client-server, stand alone application, web based service, and/or the like. Also, the online platform can be accessed by users, customers, and third parties, with one or more different types of computing devices, including, but not limited to, personal computers, video game consoles, mobile telephones, smart watches, pagers, and/or personal digital assistants (PDA).

Illustrative Operating Environment

FIG. 1 shows components of one embodiment of an environment in which the invention may be practiced. Not all the components may be required to practice the invention, and variations in the arrangement and type of the components may be made without departing from the spirit or scope of the invention. As shown, system 100 of FIG. 1 includes local area networks ("LANs")/wide area networks ("WANs")-(network) 105, wireless network 110, third party server 106, website server 107, tracking assist server 108, mobile (wireless) devices 102-104, and client device 101.

One embodiment of mobile devices 102-104 is described in more detail below in conjunction with FIG. 2. Generally, however, mobile devices 102-104 may include virtually any portable computing device capable of receiving and sending a message over a network, such as network 105, wireless network 110, or the like. Mobile devices 102-104 may also be described generally as client devices that are configured to be portable. Thus, mobile devices 102-104 may include virtually any portable computing device capable of connecting to another computing device and receiving information. Such devices include portable devices such as, cellular telephones, smart phones, display pagers, radio frequency (RF) devices, infrared (IR) devices, Personal Digital Assistants (PDAs), handheld computers, laptop computers, wearable computers, tablet computers, integrated devices combining one or more of the preceding devices, and the like. As such, mobile devices 102-104 typically range widely in terms of capabilities and features. For example, a cell phone may have a numeric keypad and a few lines of monochrome display on which only text may be displayed. In another example, a web-enabled mobile device may have a touch sensitive screen, a stylus, and several lines of a color display in which both text and graphics may be displayed.

Figure 3:
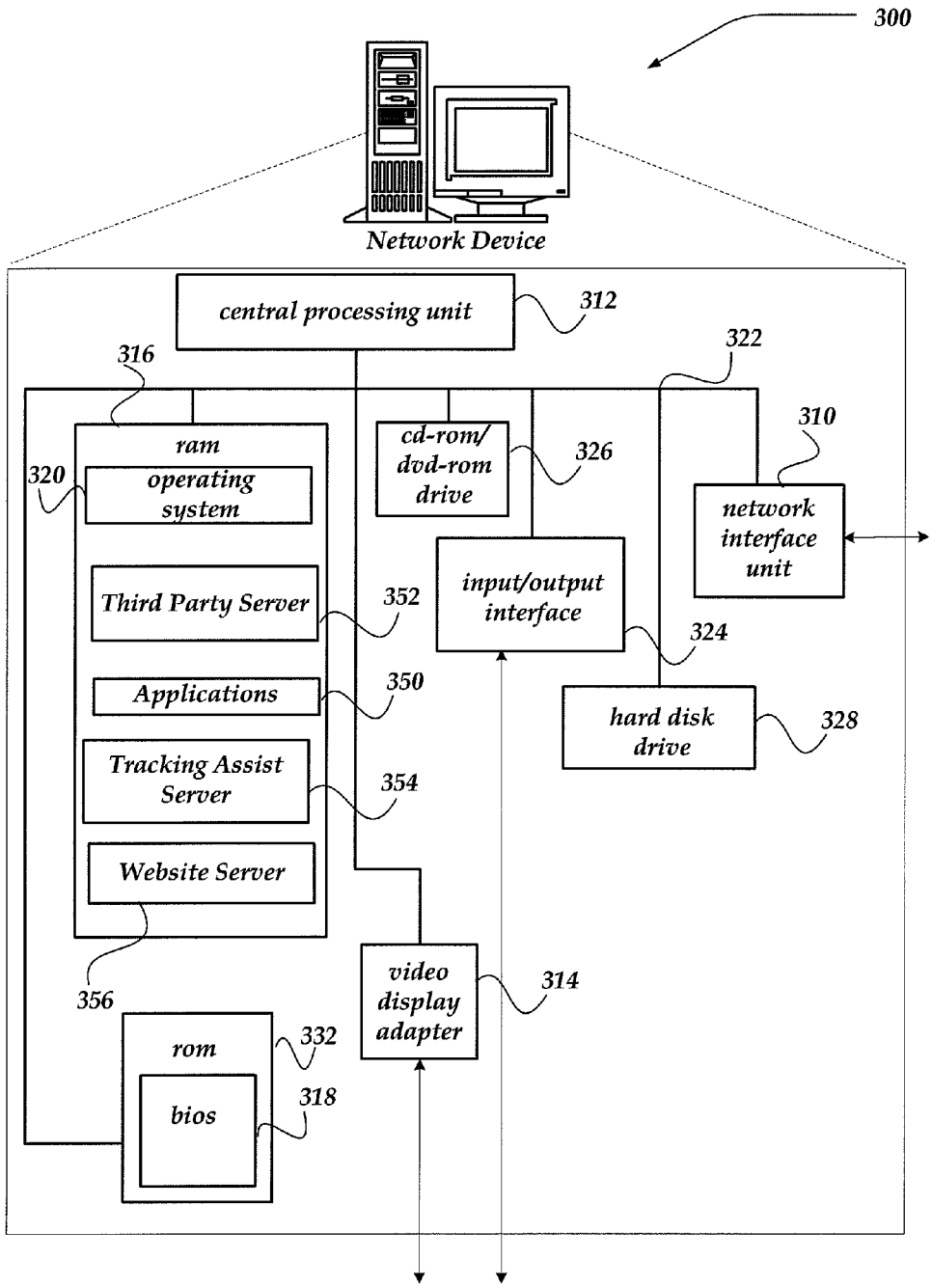
FIG. 3 illustrates a schematic diagram of one embodiment of an exemplary network device.

Client device 101 may include virtually any computing device capable of communicating over a network to send and receive information, such as network device 300 shown in FIG. 3, or the like. The set of such client devices may include devices that typically connect using a wired or wireless communications medium such as personal computers, multiprocessor systems, microprocessor-based or programmable consumer electronics, network PCs, or the like.

Mobile devices 102-104 as well as client device 101 may further be configured to include a client application that enables an end-user to log into a membership account on platform 112 that includes servers 106, 107, and 108. Such an end-user membership account, for example, may be configured to enable one or more activities, including: enabling the member to send/receive messages with other members, non-members, and the platform administrator(s); access content on selected web pages; access chat rooms; access blogs; access reviews of products and services by industry experts and/or other members; purchase products and/or services; and try out available demonstrations for products/services prior to purchase. However, participation in at least some of these activities may also be performed without logging into the end-user membership account. Additionally, mobile devices 102-104 may also communicate with non-mobile (wired) client devices, such as client device 101, or the like.

Wireless network 110 is configured to couple mobile devices 102-104 and its components with communication provided over network 105. Wireless network 110 may include any of a variety of wireless sub-networks that may further overlay stand-alone ad-hoc networks, and the like, to provide an infrastructure-oriented connection for mobile devices 102-104. Such sub-networks may include mesh networks, Wireless LAN (WLAN) networks, cellular networks, and the like.

Wireless network 110 may further employ a plurality of access technologies including 2nd (2G), 3rd (3G), and 4th (4G) generation radio access for cellular systems, WLAN, WiMax, Wireless Router (WR) mesh, and the like. Access technologies such as 2G, 3G, 3G, and future wireless access networks may enable wide area coverage for mobile devices, such as mobile devices 102-104 with various degrees of mobility. For example, wireless network 110 may enable a radio connection through a radio network access such as Global System for Mobile communication (GSM), General Packet Radio Services (GPRS), Enhanced Data GSM Environment (EDGE), Wideband Code Division Multiple Access (WCDMA), Universal Mobile Telephone System (UMTS), and the like. In essence, wireless network 110 may include virtually any wireless communication mechanism by which information may travel between mobile devices 102-104 and another computing device, network, and the like.

Network 105 is configured to couple platform 112 and its servers with other computing devices, including, mobile devices 102-104, client device 101, and through wireless network 110 to mobile devices 102-104. Network 105 is enabled to employ any form of computer readable media for communicating information from one electronic device to another. Also, network 105 can include the Internet in addition to local area networks (LANs), wide area networks (WANs), direct connections, such as through a universal serial bus (USB) port, other forms of computer-readable media, or any combination thereof. On an interconnected set of LANs, including those based on differing architectures and protocols, a router acts as a link between LANs, enabling messages to be sent from one to another. Also, communication links within LANs typically include twisted wire pair or coaxial cable, while communication links between networks may utilize analog telephone lines, full or fractional dedicated digital lines including T1, T2, T3, and T4, Integrated Services Digital Networks (ISDNs), Digital Subscriber Lines (DSLs), wireless links including satellite links, or other communications links known to those skilled in the art. Furthermore, remote computers and other related electronic devices could be remotely connected to either LANs or WANs via a modem and temporary telephone link. In essence, network 105 includes any communication method by which information may travel between platform 112, client device 101, and other computing devices.

Additionally, communication media typically embodies processor-readable instructions, data structures, program modules, or other data in a modulated data signal such as a carrier wave, data signal, or other transport mechanism and includes any information delivery media. The terms "modulated data signal," and "carrier-wave signal" includes a signal that has one or more of its characteristics set or changed in such a manner as to encode information, instructions, data, and the like, in the signal. By way of example, communication media includes wired media such as twisted pair, coaxial cable, fiber optics, wave guides, and other wired media and wireless media such as acoustic, RF, infrared, and other wireless media.

Platform 112 can also include a variety of services used to provide services to remotely located members. Such services include, but are not limited to web services, third-party services, audio services, video services, email services, Instant Messaging (IM) services, Short Message Service (SMS) services, Multimedia Messaging Service (MMS) services, Voice Over Internet Protocol (VOIP) services, video game services, blogs, chat rooms, gaming services, calendaring services, shopping services, photo services, or the like. Although FIG. 1 illustrates platform 112 including servers 106, 107, and 108 as physically separate computing devices, the invention is not so limited. For example, one or all of the servers can be operated on one computing device, without departing from the scope or spirit of the present invention. Also, devices that may operate as platform 112 include personal computers desktop computers, multiprocessor systems, microprocessor-based or programmable consumer electronics, network PCs, servers, and the like.

Tracking assist server 108 represents an embodiment of a tracking assist server of the present invention. Website server 107 and/or third party server 106 can act in conjunction with tracking assist server 108 to enable a user to register a mobile device, request a report from the mobile device, access a report received from the mobile device, as well as perform other functions in accordance with the present invention. Third party server 106 represents a server that is associated with an entity separate from the entity associated with the tracking assist server 108. For example, third party server 106 can be a server operated by a phone company providing an interface for its clients to access tracking assist server 108, which is operated by a another entity.

Illustrative Mobile Device

Figure 2:
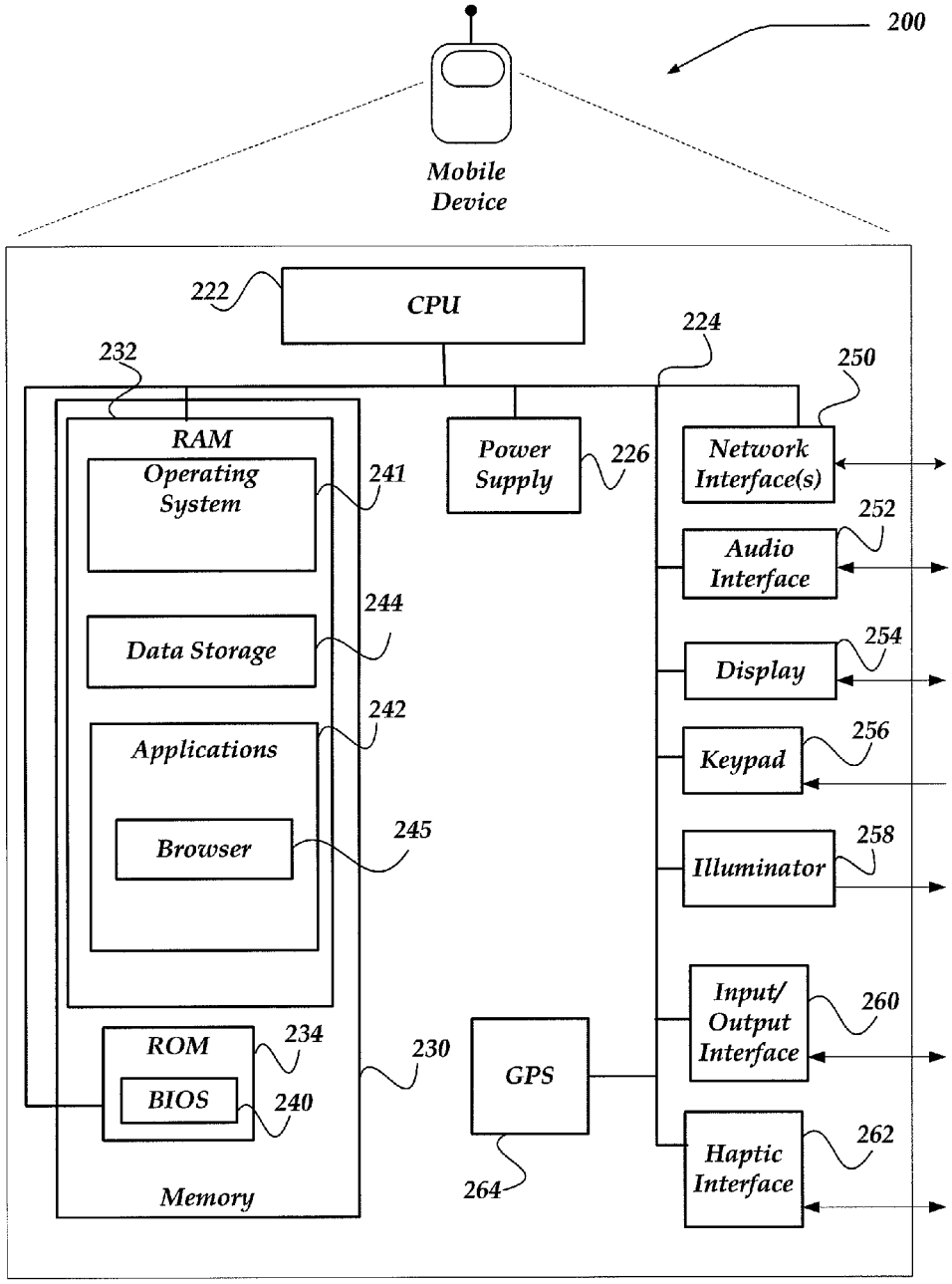
FIG. 2 illustrates a schematic diagram of one embodiment of an exemplary mobile device.

FIG. 2 shows one embodiment of mobile device 200 that may be included in a system implementing the invention. Mobile device 200 may include many more or less components than those shown in FIG. 2. However, the components shown are sufficient to disclose an illustrative embodiment for practicing the present invention. Mobile device 200 may represent, for example, mobile devices 102-104 of FIG. 1.

As shown in the figure, mobile device 200 includes a processing unit (CPU) 222 in communication with a mass memory 230 via a bus 224. Mobile device 200 also includes a power supply 226, one or more network interfaces 250, an audio interface 252, a display 254, a keypad 256, an illuminator 258, an input/output interface 260, a haptic interface 262, and an optional global positioning systems (GPS) receiver 264. Power supply 226 provides power to mobile device 200. A rechargeable or non-rechargeable battery may be used to provide power. The power may also be provided by an external power source, such as an AC adapter or a powered docking cradle that supplements and/or recharges a battery.

Mobile device 200 may optionally communicate with a base station (not shown), or directly with another computing device. Network interface 250 includes circuitry for coupling mobile device 200 to one or more networks, and is constructed for use with one or more communication protocols and technologies including, but not limited to, global system for mobile communication (GSM), code division multiple access (CDMA), Wide CDMA (CDMA), time division multiple access (TDMA), Universal Mobile Telephone Service (UMTS), user datagram protocol (UDP), transmission control protocol/Internet protocol (TCP/IP), SMS, general packet radio service (GPRS), WAP, ultra wide band (UWB), IEEE 802.16 Worldwide Interoperability for Microwave Access (WiMax), SIP/RTP, or any of a variety of other wireless communication protocols. Network interface 250 is sometimes known as a transceiver, transceiving device, or network interface card (NIC).

Audio interface 252 is arranged to produce and receive audio signals such as the sound of a human voice. For example, audio interface 252 may be coupled to a speaker and microphone (not shown) to enable telecommunication with others and/or generate an audio acknowledgement for some action. Display 254 may be a liquid crystal display (LCD), gas plasma, light emitting diode (LED), or any other type of display used with a computing device. Display 254 may also include a touch sensitive screen arranged to receive input from an object such as a stylus or a digit from a human hand.

Keypad 256 may comprise any input device arranged to receive input from a user. For example, keypad 256 may include a push button numeric dial, or a keyboard. Keypad 256 may also include command buttons that are associated with selecting and sending images. Illuminator 258 may provide a status indication and/or provide light. Illuminator 258 may remain active for specific periods of time or in response to events. For example, when illuminator 258 is active, it may backlight the buttons on keypad 256 and stay on while the client device is powered. Also, illuminator 258 may backlight these buttons in various patterns when particular actions are performed, such as dialing another client device. Illuminator 258 may also cause light sources positioned within a transparent or translucent case of the client device to illuminate in response to actions.

Mobile device 200 also comprises input/output interface 260 for communicating with external devices, such as a headset, or other input or output devices not shown in FIG. 2. Input/output interface 260 can utilize one or more communication technologies, such as USB, infrared, Bluetooth™, or the like. Haptic interface 262 is arranged to provide tactile feedback to a user of the client device. For example, the haptic interface may be employed to vibrate mobile device 200 in a particular way when another user of a computing device is calling.

Optional GPS transceiver 264 can determine the physical coordinates of mobile device 200 on the surface of the Earth, which typically outputs a location as latitude and longitude values. GPS transceiver 264 can also employ other geo-positioning mechanisms, including, but not limited to, triangulation, assisted GPS (AGPS), E-OTD, CI, SAI, ETA, BSS or the like, to further determine the physical location of mobile device 200 on the surface of the Earth. It is understood that under different conditions, GPS transceiver 264 can determine a physical location within millimeters for mobile device 200; and in other cases, the determined physical location may be less precise, such as within a meter or significantly greater distances. In one embodiment, however, mobile device may through other components, provide other information that may be employed to determine a physical location of the device, including for example, a MAC address, IP address, or the like.

Mass memory 230 includes a RAM 232, a ROM 234, and other storage means. Mass memory 230 illustrates another example of computer storage media for storage of information such as processor readable instructions, data structures, program modules or other data. Mass memory 230 stores a basic input/output system ("BIOS") 240 for controlling low-level operation of mobile device 200. The mass memory also stores an operating system 241 for controlling the operation of mobile device 200. It will be appreciated that this component may include a general purpose operating system such as a version of UNIX, or LINUX™, or a specialized client communication operating system such as Windows Mobile™, or the Symbian® operating system. The operating system may include, or interface with a Java virtual machine module that enables control of hardware components and/or operating system operations via Java application programs.

Memory 230 further includes one or more data storage 244, which can be utilized by mobile device 200 to store, among other things, applications 242 and/or other data. For example, data storage 244 may also be employed to store information that describes various capabilities of mobile device 200. The information may then be provided to another device based on any of a variety of events, including being sent as part of a header during a communication, sent upon request, or the like.

Applications 242 may include computer executable instructions which, when executed by mobile device 200, transmit, receive, and/or otherwise process messages (e.g., SMS, MMS, IM, email, and/or other messages), audio, video, and enable telecommunication with another user of another client device. Other examples of application programs include calendars, browsers, email clients, IM applications, SMS applications, VOIP applications, contact managers, task managers, transcoders, database programs, word processing programs, security applications, spreadsheet programs, video games, gaming programs, search programs, shopping cart programs, and so forth. Applications 242 may further include browser 245. The browser application may be configured to receive and display graphics, text, multimedia, and the like, employing virtually any web based language, including a wireless application protocol messages (WAP), and the like. In one embodiment, the browser application for the mobile device is enabled to employ Handheld Device Markup Language (HDML), Wireless Markup Language (WML), WMLScript, JavaScript, Standard Generalized Markup Language (SMGL), HyperText Markup Language (HTML), eXtensible Markup Language (XML), and the like, to display content and communicate messages.

Browser 245 may be configured to receive and enable a display of rendered content provided by platform 112. Further, browser 245 enables the user of mobile device 200 to select different actions displayed by the rendered content. In at least one embodiment, browser 245 enables the user to select one or more of a product to purchase, search for content and display the result, call another telephonic device, display and respond to messages, or the like.

Illustrative Network Device

FIG. 3 shows one embodiment of a network device, according to one embodiment of the invention. Network device 300 may include many more or less components than those shown. The components shown, however, are sufficient to disclose an illustrative embodiment for practicing the invention. Network device 300 may represent, for example, third party server 106, website server 107, tracking assist server 108, and/or client device 101 of FIG. 1.

Network device 300 includes processing unit 312, video display adapter 314, and a mass memory, all in communication with each other via bus 322. The mass memory generally includes RAM 316, ROM 332, and one or more permanent mass storage devices, such as hard disk drive 328, cd-rom/dvd-rom drive 326, tape drive, optical drive, and/or floppy disk drive. The mass memory stores operating system 320 for controlling the operation of network device 300. Any general-purpose operating system may be employed. Basic input/output system ("BIOS") 318 is also provided for controlling the low-level operation of network device 300. As illustrated in FIG. 3, network device 300 also can communicate with the Internet, or some other communications network, via network interface unit 310, which is constructed for use with various communication protocols including the TCP/IP protocol. Network interface unit 310 is sometimes known as a transceiver, transceiving device, or network interface card (NIC). Network device 300 also comprises input/output interface 324 for communicating with external devices, such as a mouse, keyboard, headset, or other input or output devices not shown in FIG. 3. Input/output interface 324 can utilize one or more communication technologies, such as USB, infrared, Bluetooth™, or the like.

The mass memory as described above illustrates another type of processor-readable storage media. Processor readable storage media may include volatile, nonvolatile, removable, and non-removable media implemented in any method or technology for storage of information, such as processor readable instructions, data structures, program modules, code, or other data. Examples of processor readable storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed and read by a processor for a computing device.

The mass memory also stores program code and data. One or more applications 350 are loaded into mass memory and run on operating system 320. Examples of application programs may include transcoders, schedulers, calendars, database programs, word processing programs, HTTP programs, customizable user interface programs, IPSec applications, encryption programs, security programs, VPN programs, SMS message servers, IM message servers, email servers, account management and so forth. Tracking assist server 354, website server 356, and third party server 352 may also be included as an application program within applications 350. When tracking assist server 354, website server 356, or third party server 352 is executing on network device 300, the network device can represent tracking assist server 108, website server 107, and third party server 106 respectively. Also, tracking assist server 354, website server 356, and third party server 352 can be configured as a platform for enabling the performance of the present invention.

Illustrative User Interface

Figure 4:
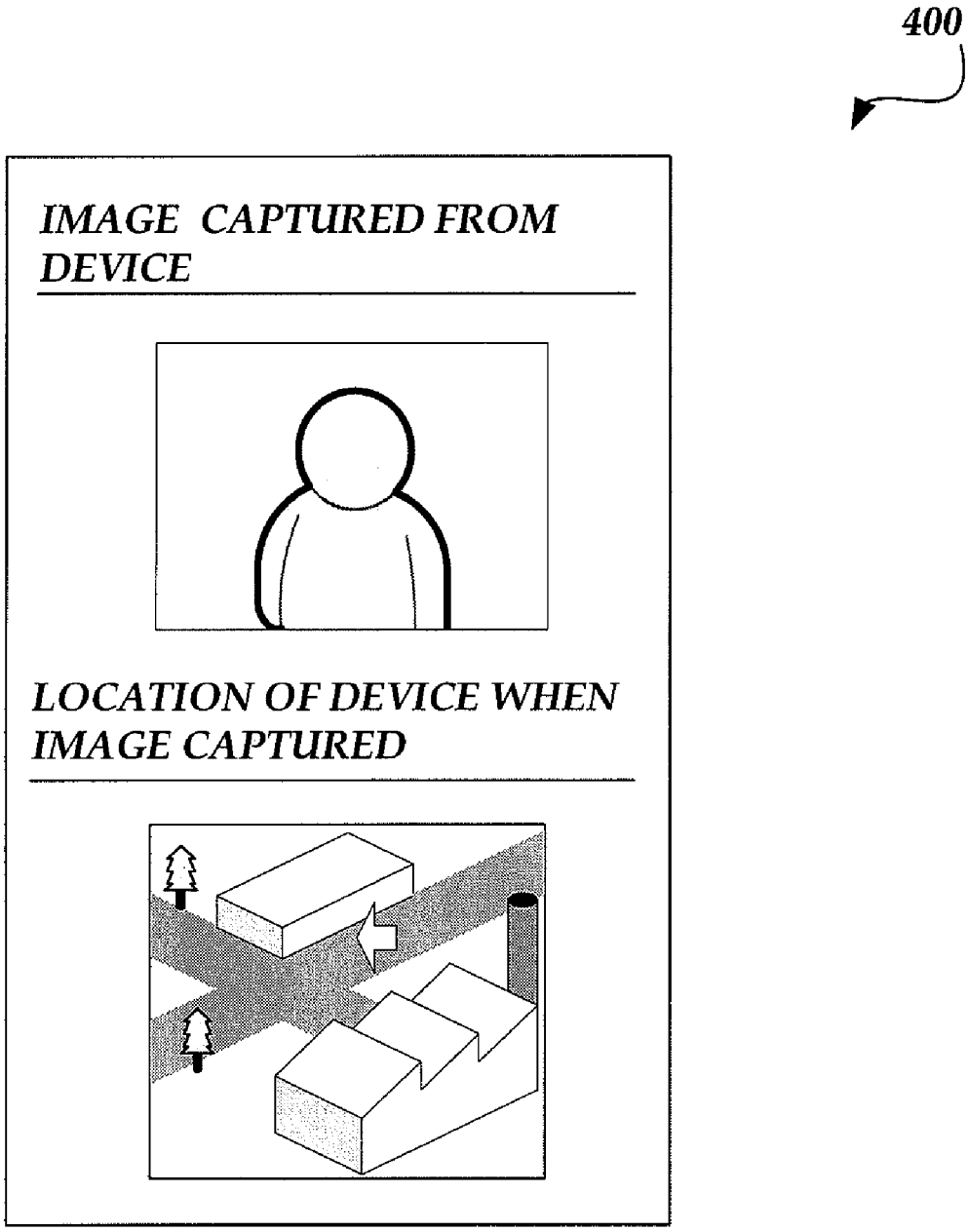
FIG. 4 illustrates an exemplary user interface for browsing an exemplary report generated by a mobile device.

FIG. 4 illustrates an exemplary user interface 400 for browsing an exemplary report generated by a mobile device of the present invention. In one section of the user interface, information about the surrounding environment of the mobile device is provided based on the at least one sensory datum in the report. As shown, a photo of the surrounding environment of the mobile device as captured by a camera on the mobile device is displayed and includes an image of a person who was near the mobile device at the time the report was generated.

In another section of the user interface, at least an approximate geographic location of the mobile device is provided based on the at least one locating datum in the report. As shown, a map is displayed indicating a location of the mobile device at the time the report was generated.

Illustrative Flow Charts

Figure 5A:
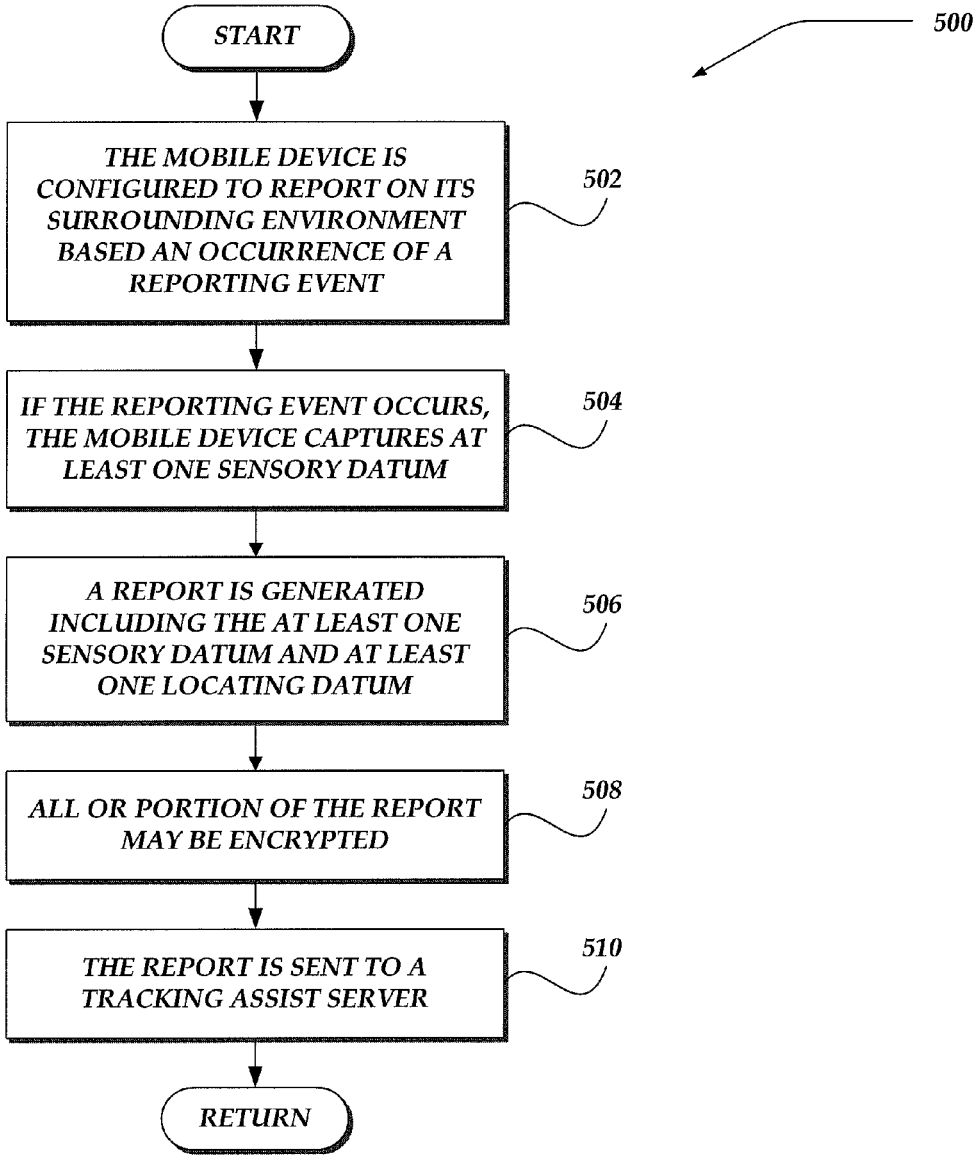
FIG. 5A is a flow chart of an exemplary process of a mobile device which reports on its surrounding environment to assist a user in tracking the mobile device.

FIG. 5A is a flow chart of an exemplary process 500 of a mobile device which reports on its surrounding environment to assist a user in tracking the mobile device. Moving from a start block, the process steps to block 502 where the mobile device is configured to report on its surrounding environment based on an occurrence of a reporting event. A reporting event specifies a circumstance under which the mobile device is configured to report on its surroundings. A reporting event can be defined by any activity involving the mobile device including a user interaction with the mobile device, a change in a state of the mobile device, a communication with another device over a network, and the like. For example, a reporting event can be defined as a starting of a browser on the mobile device. In one instance, a mobile device is configured to report on its surrounding environment upon the starting of a browser by configuring the browser to load a home page which contains executable code for causing the mobile device to report on its surrounding environment.

Advancing to block 504, if a reporting event occurs, the mobile device captures at least one sensory datum utilizing at least one sensor on the mobile device. For example, if a mobile device includes a camera, the mobile device may capture an image of the surrounding environment upon an occurrence of a reporting event. The captured image may contain a picture of a person in the surrounding environment and if the mobile device has been stolen, the person in the image may be identified as the thief.

Flowing to block 506, a report is generated including at least one sensory datum and at least on locating datum. A locating datum can provide the geographic location of the mobile device or can be used to ascertain the geographic location of the mobile device. For example, a locating datum can be a dynamic IP address assigned to the mobile device. A dynamic IP address can be used to obtain an approximate geographic location of the mobile device by referring to a table which maps IP addresses with geographic locations. Additionally, further processing can be performed on the at least one sensory datum and the at least one locating datum to generate the report. For example, a map indicating the location of the mobile device based on the at least one locating datum can be included in the report. Furthermore, a report can be formatted as one or more packets, an email, or the like. In one instance, the at least one locating datum is included as a part of a header of a packet and the at least one sensory datum is included as a part of a payload of the packet.

Next, advancing to block 508, all or at least a portion of the report can be encrypted. Encryption is utilized to enable privacy and limit the tracking of the mobile device to a select group which can include one or more authorized users.

Moving to block 510, the report is sent to a tracking assist server. A tracking assist server can be any server which can receive a report from the mobile device and enable a user to browse the report. In one instance, a tracking assist server is an email server. In another instance, a tracking assist server is a web server. Next, the process returns to performing other actions.

Figure 5B:
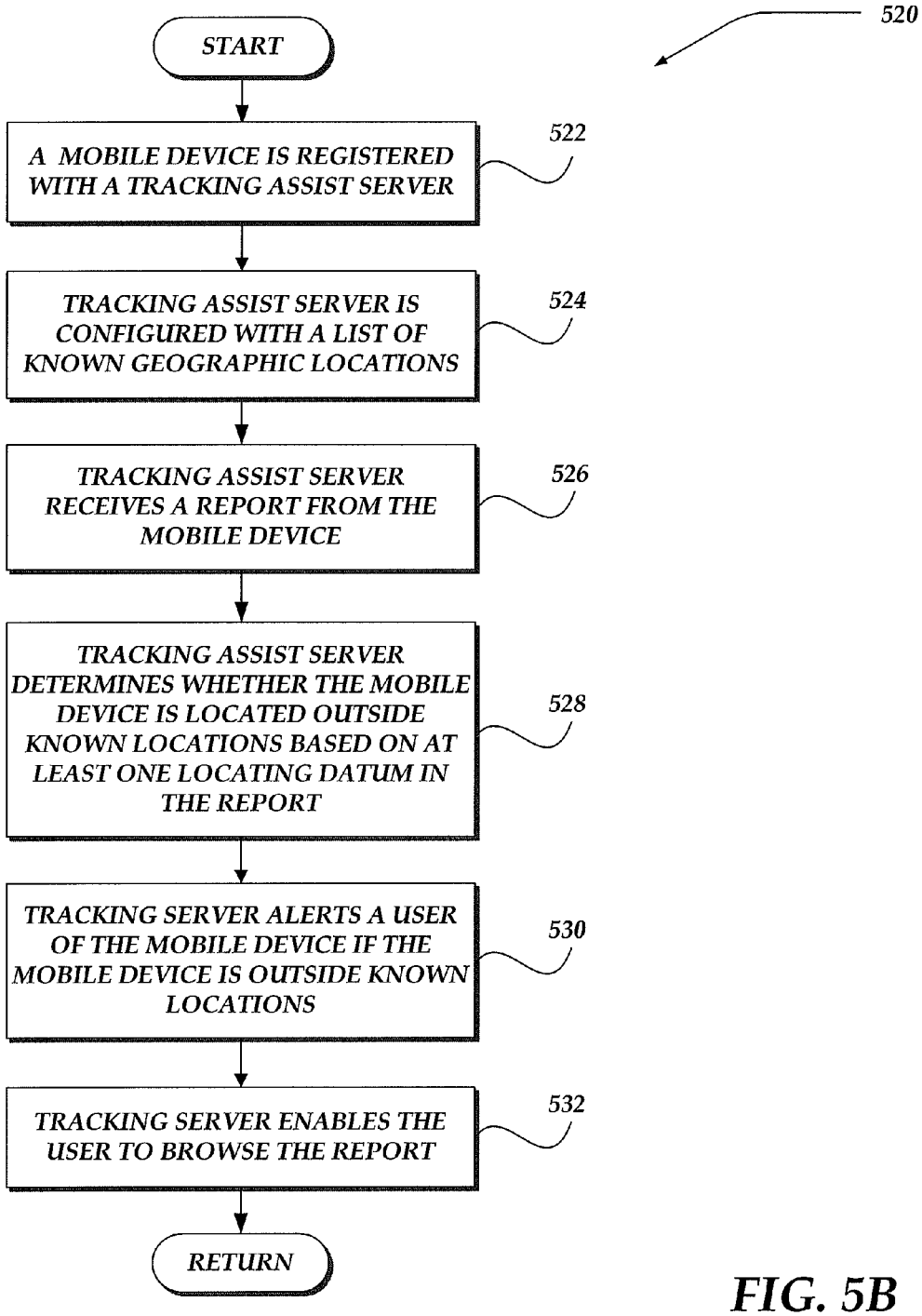
FIG. 5B is a flow chart of an exemplary process of a system for monitoring the surrounding environment of a mobile device to assist a user in tracking the mobile device.

FIG. 5B is a flow chart of an exemplary process 520 of a system for monitoring the surrounding environment of a mobile device to assist a user in tracking the mobile device. Moving from a start block, the process steps to block 522 where a user registers a mobile device with a tracking assist server. In at least one or more embodiments, registration of the mobile device can require a creation of a user account with the tracking assist server and/or associating the mobile device with a user account.

Advancing to block 524, an interface is provided to enable the user to configure the tracking assist server with a list of known geographic locations for the mobile device.

Flowing to block 526, the tracking assist server receives a report from the mobile device which includes information about its surrounding environment including at least one sensory datum and at least one locating datum. The report is generated as a result of an occurrence of a reporting event on the mobile device. An exemplary process of a mobile device which reports on its surrounding environment to the tracking assist server is described with reference to FIG. 5A above.

Continuing to block 528, the tracking assist server determines whether the mobile device is located outside of the known geographic locations for the mobile device based on the at least one locating datum in the report.

Moving to block 530, if the mobile device is located outside of the known geographic locations for the mobile device, the tracking assist server alerts a user that the mobile device is in an unfamiliar location. Accordingly, a user can configure the tracking assist server in block 524 to alert the user if the mobile device generates a report outside of, for example, his/her home, office, or city.

Next, advancing to block 532, the tracking assist server enables the user to browse the report whether the user has been alerted of the report in block 530. Accordingly, the user can track and monitor the surrounding environment of the mobile device based on reports generated by the mobile device as a result of one or more reporting events. Furthermore, in at least one or more embodiments, if the user wishes to obtain a report of the mobile device's current surrounding environment, the user can cause the tracking assist server to send a request to the mobile device to produce a report. Next, the process returns to performing other actions.

It will be understood that each block of the above flowchart illustrations, and combinations of blocks in the flowchart illustrations, can be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer implemented process such that the instructions executing on the processor provide steps for implementing the actions listed in the flowcharts discussed above.

Accordingly, blocks of the flowchart illustrations support combinations of means for performing the specified actions, combinations of steps for performing the specified actions and program instruction means for performing the specified actions. It will also be understood that each block of the flowchart illustration, and combinations of blocks in the flowchart illustration, can be implemented by special purpose hardware-based systems which perform the specified actions or steps, or combinations of special purpose hardware and computer instructions.

In the foregoing specification, the invention has been described with reference to specific exemplary embodiments thereof. It will, however, be evident that various modifications and changes may be made to the specific exemplary embodiments without departing from the broader spirit and scope of the invention as set forth in the appended claims. Accordingly, the specification and drawings are to be regarded in an illustrative rather than a restrictive sense.

What is claimed as new and desired to be protected by Letters Patent of the United States is:

1. A mobile device that reports on its external surrounding environment over a network to assist a user in tracking the mobile device, comprising:

a sensor;

a memory for storing processor executable instructions; and a processor for executing the stored instructions to enable actions, including:

enabling manual configuring of the mobile device to automatically report on its surrounding environment to a server over the network based on a subsequent occurrence of at least one selected type of a plurality of types of reporting events;

if the at least one selected type of reporting event occurs, capturing at least one sensory datum related to the external surrounding environment of the mobile device via the sensor and at least one locating datum that is provided prior to an occurrence of the reporting event, wherein the at least one locating datum includes an IP address that is currently valid and assigned to the mobile device and further corresponds to an entry in a table of IP addresses that are mapped to geographic locations;

generating a report that includes the at least one sensory datum and the at least one locating datum, wherein the locating datum is employed to provide at least an approximate geographic location of the mobile device for display on a map; and sending the report over the network to the server to enable the user to review the type of the reporting event, the sensory datum and the location displayed on the map for remotely monitoring the surrounding environment of the mobile device at the time that the at least one selected type of the reporting event occurred.

2. The mobile device of claim 1, wherein the sensor is at least one of: a camera, a thermometer, a microphone, an accelerometer, a light meter, a global positioning system (GPS) receiver, or a transceiver.

3. The mobile device of claim 1, wherein the at least one sensory datum includes at least one of: an image of the surrounding environment, an audio recording of the surrounding environment, an acceleration associated with the surrounding environment, a light level of the surrounding environment, a location of the surrounding environment, or an identifying information of a network device in the surrounding environment.

4. The mobile device of claim 1, wherein the at least one locating datum can be used to determine a geographic location of the mobile device and includes at least one of: a street address, a latitude coordinate, a longitude coordinate, a zip code, a network address, the IP address, a cell tower identification, or an access point name.

5. The mobile device of claim 1, wherein the reporting event is one of: a startup of a browser application, a startup of the mobile device, an awakening of the mobile device from a sleep mode, a gaining of an access to the network, a failed attempt to enter a password, a failed attempt to unlock the mobile device, or a request for a report received over the network.

6. The mobile device of claim 1, wherein the actions further include:

registering the mobile device with the server;

specifying to the server at least one known geographic location; and configuring the server to alert the user if the at least one locating datum indicates that the mobile device is located outside of the at least one known geographic location.

7. The mobile device of claim 6, wherein the user is alerted by at least one of: an email, a text message, a page, or a telephone call.

8. The mobile device of claim 1, wherein the action of sending includes encrypting at least a portion of the report.

9. The mobile device of claim 1, wherein the mobile device is integrated with a vehicle to thereby assist in the tracking of the vehicle.

10. A system for monitoring the external surrounding environment of a mobile device to assist a user in tracking the mobile device, the system comprising a client and a server, wherein:

the client executes stored instructions to enable client actions, including:

enabling manual configuring of the mobile device to automatically report on its surrounding environment to the server based on a subsequent occurrence of at least one selected type of a plurality of types of reporting events;

if the at least one selected type of reporting event occurs, capturing at least one sensory datum related to the external surrounding environment of the mobile device via the sensor and at least one locating datum;

if the at least one selected type of reporting event occurs, capturing at least one sensory datum related to the external surrounding environment of the mobile device via the sensor and at least one locating datum that is provided prior to an occurrence of the reporting event, wherein the at least one locating datum includes an IP address that is currently valid and assigned to the mobile device and further corresponds to an entry in a table of IP addresses that are mapped to geographic locations;

generating a report that includes the at least one sensory datum and the at least one locating datum, wherein the locating datum is employed to provide at least an approximate geographic location of the mobile device for display on a map; and sending the report to the server; and the server executes stored instructions to enable server actions, including:

enabling the user to access the report received from the client to allow the user to review the type of the reporting event, the sensory datum and the location displayed on the map for remotely monitoring the surrounding environment of the mobile device at the time that the at least one selected type of reporting event occurred.

11. The system of claim 10, wherein the client actions further include:

registering the mobile device with the server;

specifying to the server at least one known geographic location.

12. The system of claim 11, wherein the server actions further include:

determining whether the at least one locating datum indicates that the mobile device is located outside of the at least one known geographic location; and if the mobile device is located outside of the at least one known geographic location, alerting the user.

13. The system of claim 10, wherein the server is arranged as one of the mobile device or a networked device.

14. A processor-readable non-transitory storage medium having processor-executable instructions stored therein, which when executed by one or more processors, enables actions, comprising:

enabling manual configuring of the mobile device to automatically report on its surrounding environment to a server over the network based on a subsequent occurrence of at least one selected type of a plurality of types of reporting events;

if the at least one selected type of reporting event occurs, capturing at least one sensory datum related to the external surrounding environment of the mobile device via the sensor and at least one locating datum that is provided prior to an occurrence of the reporting event, wherein the at least one locating datum includes an IP address that is currently valid and assigned to the mobile device and further corresponds to an entry in a table of IP addresses that are mapped to geographic locations;

generating a report that includes the at least one sensory datum and at the least one locating datum, wherein the locating datum is employed to provide at least an approximate geographic location of the mobile device for display on a map; and sending the report over the network to the server to enable the user to review the type of the reporting event, the sensory datum and the location displayed on the map for remotely monitoring the surrounding environment of the mobile device at the time that the at least one selected type of reporting event occurred.

15. The processor-readable medium of claim 14, wherein the actions further comprise:

registering the mobile device with the server;

specifying to the server at least one known geographic location; and configuring the server to alert the user if the at least one locating datum indicates that the mobile device is located outside of the at least one known geographic location.

16. The processor-readable medium of claim 14, wherein the actions further comprise encrypting at least a portion of the report.

17. The processor-readable medium of claim 14 wherein at least one of the processor-executable instructions is downloaded.

18. A method for remotely monitoring on the external surrounding environment of a mobile device to assist a user in tracking the mobile device, comprising:

enabling manual configuring of the mobile device to automatically report on its surrounding environment to a server over the network based on a subsequent occurrence of at least one selected type of a plurality of types of reporting events, wherein the mobile device is configured to perform actions if the reporting event occurs, the actions including:

if the at least one selected type of reporting event occurs, capturing at least one sensory datum related to the external surrounding environment of the mobile device via the sensor and at least one locating datum that is provided prior to an occurrence of the reporting event, wherein the at least one locating datum includes an IP address that is currently valid and assigned to the mobile device and further corresponds to an entry in a table of IP addresses that are mapped to geographic locations;

generating a report that includes the at least one sensory datum and the at least one locating datum, wherein the locating datum is employed to provide at least an approximate geographic location of the mobile device for display on a map; and sending the report over the network to the server to enable the user to review the type of the reporting event, the sensory datum and the location displayed on the map; and enabling remote monitoring of the surrounding environment of the mobile device at the time that the at least one selected type of reporting event occurred by accessing the report sent to the server.

19. The method of claim 18, further comprising:

registering the mobile device with the server;

specifying to the server at least one known geographic location; and configuring the server to alert a user if the at least one locating datum indicates that the mobile device is located outside of the at least one known geographic location.

20. The method of claim 18, wherein the action of sending includes the action of encrypting at least a portion of the report.

* * * * *